US009423166B2

(12) United States Patent
Kim et al.

(10) Patent No.: US 9,423,166 B2
(45) Date of Patent: Aug. 23, 2016

(54) REFRIGERATOR

(71) Applicant: LG Electronics Inc., Seoul (KR)

(72) Inventors: Dongjeong Kim, Seoul (KR); Wookyong Lee, Seoul (KR); Juhyun Son, Seoul (KR)

(73) Assignee: LG Electronics Inc., Seoul (KR)

( * ) Notice: Subject to any disclaimer, the term of this patent is extended or adjusted under 35 U.S.C. 154(b) by 500 days.

(21) Appl. No.: 13/928,528

(22) Filed: Jun. 27, 2013

(65) Prior Publication Data

US 2014/0000304 A1 Jan. 2, 2014

(30) Foreign Application Priority Data

Jun. 29, 2012 (KR) ..... 10-2012-0071169

(51) Int. Cl.
*F25C 1/00* (2006.01)
*F25C 5/00* (2006.01)

(52) U.S. Cl.
CPC . *F25C 1/00* (2013.01); *F25C 5/005* (2013.01); *F25C 2400/04* (2013.01); *F25C 2500/02* (2013.01)

(58) Field of Classification Search
CPC ..... F25C 1/00; F25C 5/005; F25C 2400/04; F25C 2500/02
USPC ..... 62/344, 374, 378, 380, 389
See application file for complete search history.

(56) References Cited

U.S. PATENT DOCUMENTS 1,795,117 A 3/1931 Green
3,638,451 A * 2/1972 Brandt ..... F25C 1/22 209/666
2002/0117511 A1 8/2002 McNabb
2006/0096310 A1* 5/2006 Lee ..... F25D 17/06 62/348
2008/0134708 A1* 6/2008 Lee ..... F25C 5/005 62/340
2008/0168782 A1* 7/2008 Kavchale ..... F25C 5/005 62/137
2009/0133428 A1* 5/2009 An ..... F25C 5/005 62/320
2009/0145158 A1 6/2009 Anselmino (Continued)

FOREIGN PATENT DOCUMENTS

CN 1455856 11/2003
DE 60225529 T2 4/2009

(Continued)

OTHER PUBLICATIONS

Search Report issued in Chinese Application No. 201310269255.3 on Oct. 21, 2015, 2 pages.

(Continued)

*Primary Examiner* — Mohammad M Ali
(74) *Attorney, Agent, or Firm* — Fish & Richardson P.C.

(57) ABSTRACT

A refrigerator includes a freezing compartment and a refrigerating compartment, a refrigerating compartment door, an ice maker disposed in the freezing compartment, and an ice bank disposed on the door. The refrigerator also includes an ice transfer device configured to transfer ice made by the ice maker to the ice bank through an ice chute. The ice transfer device includes a housing and a transfer member configured to transfer ice from the housing into the ice chute. An inlet end of the ice chute is located at a point that is spaced upward from a bottom surface of the housing and extends upward from a horizontal plane at an angle that is less than an angle between the horizontal plane and a tangent that passes through an outer circumferential surface of the housing at a lower end of the inlet end of the ice chute.

20 Claims, 12 Drawing Sheets

(56) References Cited

U.S. PATENT DOCUMENTS

| | | | | |
|---|---|---|---|---|
| 2009/0145518 | A1 | 6/2009 | Hoenke | |
| 2009/0249818 | A1* | 10/2009 | Kim | F25D 23/126 62/340 |
| 2010/0313593 | A1 | 12/2010 | Lee | |
| 2011/0100046 | A1* | 5/2011 | Choi | F25C 5/005 62/320 |
| 2012/0023999 | A1* | 2/2012 | Oh | F25C 5/005 62/344 |
| 2012/0024001 | A1 | 2/2012 | Oh | |
| 2012/0024002 | A1* | 2/2012 | Oh | F25C 5/005 62/344 |
| 2013/0061626 | A1 | 3/2013 | Son | |

FOREIGN PATENT DOCUMENTS

| | | | |
|---|---|---|---|
| EP | 1 355 561 | A1 | 10/2003 |
| EP | 2 568 235 | A2 | 3/2013 |
| WO | WO 02/058528 | A1 | 8/2002 |

OTHER PUBLICATIONS

Chinese Office Action dated Feb. 9, 2015 for Chinese Application No. 201310269255.3, in English, 7 Pages.

* cited by examiner

REFRIGERATOR

CROSS-REFERENCE TO RELATED APPLICATIONS

The present application claims the benefit of priority to Korean Patent Application No. 10-2012-0071169 filed on Jun. 29, 2012, which is herein incorporated by reference in its entirety.

FIELD

The present disclosure relates to a refrigerator.

BACKGROUND

In general, refrigerators are home appliances for storing foods at a low temperature in an inner storage space covered by a door. That is, since a refrigerator cools the inside of a storage space by using cool air generated through heat-exchange with a refrigerant circulating a refrigeration cycle, foods stored in the storage space may be stored in a cooled state.

FIG. 1 illustrates an example prior art refrigerator, and FIG. 2 illustrates an example cool air circulation state inside the refrigerator shown in FIG. 1 and an ice making compartment.

Referring to FIGS. 1 and 2, a refrigerator 1 includes a cabinet 10 defining a storage space and doors 20 and 30 mounted on the cabinet 10. An outer appearance of the refrigerator 1 may be defined by the cabinet 10 and the doors 20 and 30.

The storage space within the cabinet 10 is vertically partitioned by a barrier 11. A refrigerating compartment 12 is defined in the partitioned upper side, and a freezing compartment 13 is defined in the partitioned lower side.

The doors 20 and 30 include a refrigerating compartment door 20 for opening or closing the refrigerating compartment 12 and a freezing compartment door 30 for opening or closing the freezing compartment 13. Also, the refrigerating compartment door 20 includes a pair of doors disposed on left and right sides thereof. The pair of doors includes a first refrigerating compartment door 21 and a second refrigerating compartment door 22 disposed on a right side of the first refrigerating compartment door 21. The first refrigerating compartment door 21 and the second refrigerating compartment door 22 independently rotate with respect to each other.

The freezing compartment door 30 may be provided as a slidably accessible door. The freezing compartment door 30 may be vertically provided in plurality. The freezing compartment door 30 may be provided as one door as desired.

A dispenser 23 for dispensing water or ice is disposed in one of the first refrigerating compartment door 21 and the second refrigerating compartment door 22. For example, a structure in which the dispenser 23 is disposed in the first refrigerating compartment door 21 is illustrated in FIG. 1.

An ice making compartment 40 for making and storing ice is defined in the first refrigerating compartment door 21. The ice making compartment 40 is provided as an independent insulation space. The ice making compartment 40 may be opened or closed by an ice making compartment door 41. An ice maker for making ice may be provided within the ice making compartment 40. Also, components for storing made ice or dispensing the made ice through the dispenser 23 may be provided in the ice making compartment 40.

In addition, the cool air duct 50 for supplying cool air into the ice making compartment 40 and recovering the cool air from the ice making compartment 40 is disposed in a side wall of the cabinet 10. Also, a cool air inlet 42 and a cool air outlet 43 which communicate with the cool air duct 50 when the first refrigerating compartment door 21 is closed are provided in a surface of the ice making compartment 40. Cool air introduced into the cool air inlet 42 cools the inside of the ice making compartment 40 to make ice. Then, the heat-exchanged cool air is discharged to the outside of the ice making compartment 40 through the cool air outlet 43.

A heat exchange chamber 14 partitioned from the freezing compartment 13 is defined in a rear side of the freezing compartment 13. An evaporator is provided in the heat exchange chamber 14. Cool air generated in the evaporator may be supplied into the freezing compartment 13, the refrigerating compartment 12, and the ice making compartment 40 to cool the inside of each of the freezing compartment 13, the refrigerating compartment 12, and the ice making compartment 40.

In some implementations, the cool air duct 50 communicates with the heat exchange chamber 14 and the freezing compartment 13. Thus, cool air within the heat exchange chamber 14 is introduced into the ice making compartment 40 through a supply passage 51 of the cool air duct 50. Also, cool air within the ice making compartment 40 is recovered into the freezing compartment 13 through a recovery passage 52 of the cool air duct 50. Further, ice is made and stored within the ice making compartment 40 by continuous circulation of the cool air through the cool air duct 50.

In the refrigerator having the above-described structure, the making and storage of ice are performed within the ice making compartment 40 provided in the refrigerating compartment 20, which may increase a volume of the refrigerating compartment door 20. Thus, an accommodation space defined in a back surface of the refrigerating compartment door 20 may be reduced.

Also, since cool air for making ice should be supplied up to the ice making compartment, power consumption may increase.

SUMMARY

In one aspect, a refrigerator includes a main body comprising a freezing compartment and a refrigerating compartment and a door configured to open and close at least a portion of the refrigerating compartment. The refrigerator also includes an ice maker disposed in the freezing compartment and an ice bank disposed on the door and configured to store ice made by the ice maker. The refrigerator further includes an ice transfer device configured to transfer ice made by the ice maker to the ice bank and an ice chute that connects the ice transfer device to the ice bank and defines a transfer path for ice from the ice transfer device to the ice bank. The ice transfer device includes a housing that receives ice separated from the ice maker and a transfer member accommodated within the housing and configured to transfer ice from the housing into the ice chute. An inlet end of the ice chute is located at a point that is spaced upward from a bottom surface of the housing and the ice chute extends, from the inlet end, upward from a horizontal plane at an angle. The angle at which the ice chute extends is less than an angle between the horizontal plane and a tangent that passes through an outer circumferential surface of the housing at a lower end of the inlet end of the ice chute.

Implementations may include one or more of the following features. For example, the angle at which the ice chute extends may be between about 0° to about 90°. In this example, the angle at which the ice chute extends may be between 20° to 50°. The angle at which the ice chute extends may be 45°.

In some implementations, the angle at which the ice chute extends may be between about 20° to about 50°. In these implementations, the angle at which the ice chute extends may be about 45°.

In some examples, an upper end of the inlet end of the ice chute may extend into the housing by a predetermined length. In these examples, the lower end of the inlet end of the ice chute may not extend into the housing.

In addition, the transfer member may have a plurality of lifters that radially extend from the transfer member. Each of the lifters may include a leading edge that defines a front surface of the lifter when the transfer member rotates in a forward direction, a trailing edge that defines a rear surface of the lifter when the transfer member rotates in the forward direction, and a tip part that protrudes from an end of the trailing edge toward a circumference of the transfer member. The transfer member may be configured to rotate in the forward direction to transfer ice from the housing into the ice chute.

In some implementations, an ice accommodation groove configured to accommodate ice located in the housing may be defined between each pair of adjacent lifters. In these implementations, the ice accommodation groove may have a depth ranging from about one time to about one and a half times a diameter of an ice piece the ice maker is configured to make.

In addition, a distance between the tip part and the leading edge of adjacent lifters may be about one time to about one and a half times a diameter of an ice piece the ice maker is configured to make. The plurality of lifters may be six lifters. The ice maker may be configured to make spherical ice.

In some examples, the refrigerator may include a guide part that protrudes from an inner circumferential surface of the housing and that is configured to guide ice dropping from the ice maker toward the transfer member. The guide part may include a first surface protruding downward from an inner circumferential surface of the housing and a second surface connecting an end of the first surface to the inner circumferential surface of the housing. The second surface may be rounded with a curvature that is equal to or greater than the curvature of the transfer member. The first surface may be inclined such that the first surface protrudes downward from the inner circumferential surface of the housing in an inclined manner. The first surface may be rounded such that the first surface protrudes downward from the inner circumferential surface of the housing in a rounded manner. The second surface may be rounded with a curvature that is equal to the curvature of the transfer member. The second surface may be rounded with a curvature that is greater than the curvature of the transfer member.

The details of one or more implementations are set forth in the accompanying drawings and the description below. Other features will be apparent from the description and drawings, and from the claims.

DETAILED DESCRIPTION

Figure 1:
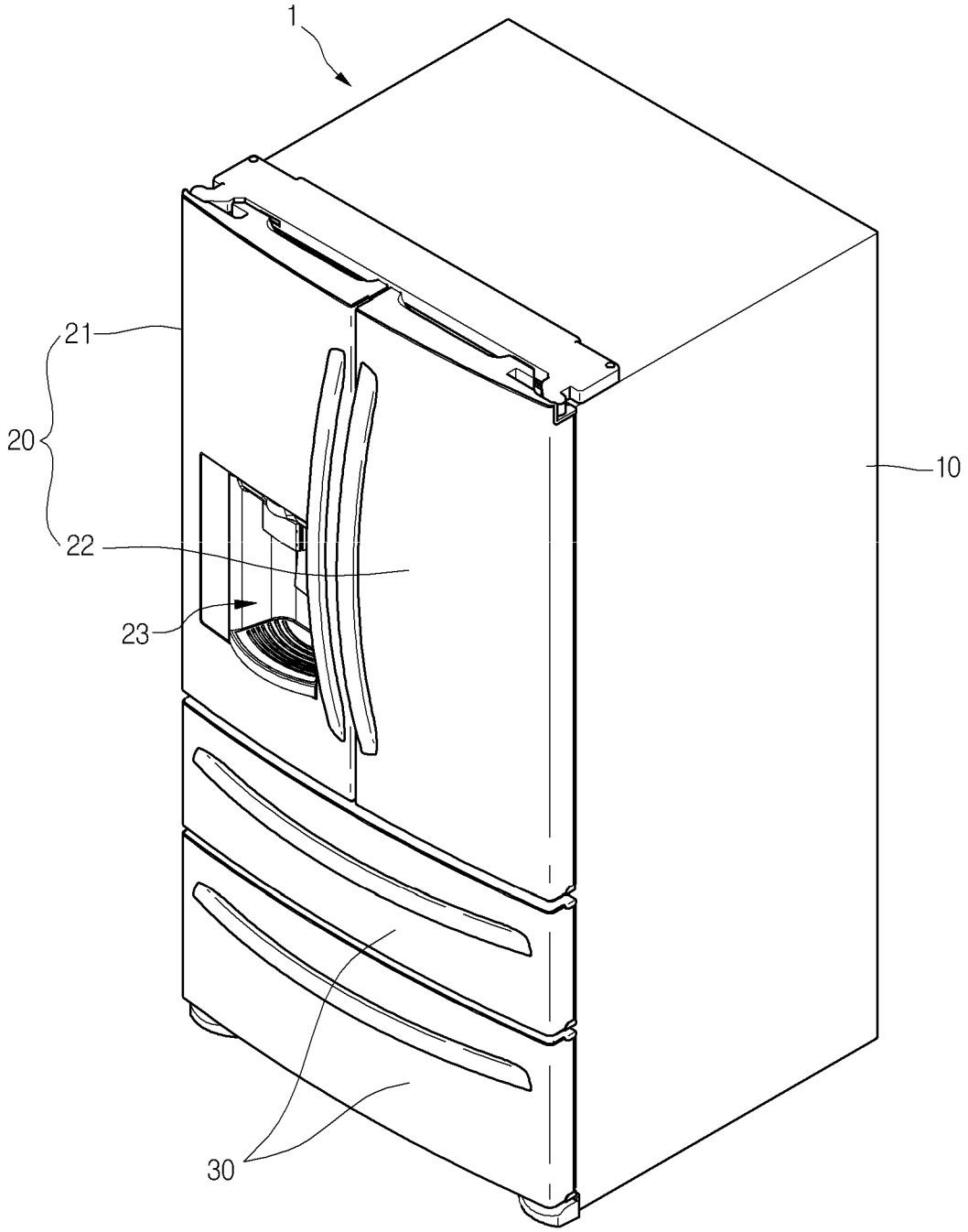
FIG. 1 is a perspective view of an example prior art refrigerator.
Figure 2:
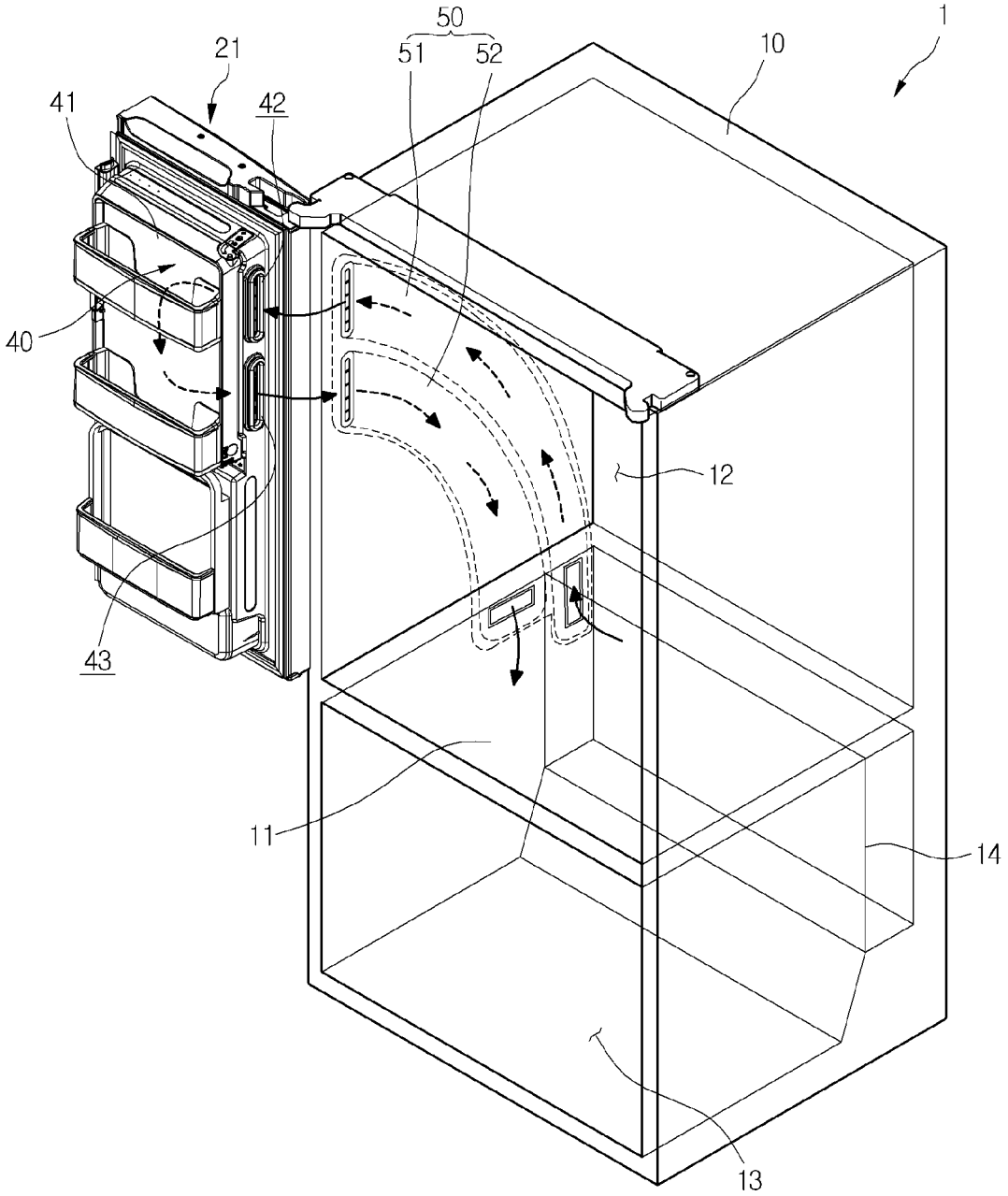
FIG. 2 is a perspective view illustrating an example cool air circulation state within the refrigerator shown in FIG. 1 and an example ice making compartment.
Figure 3:
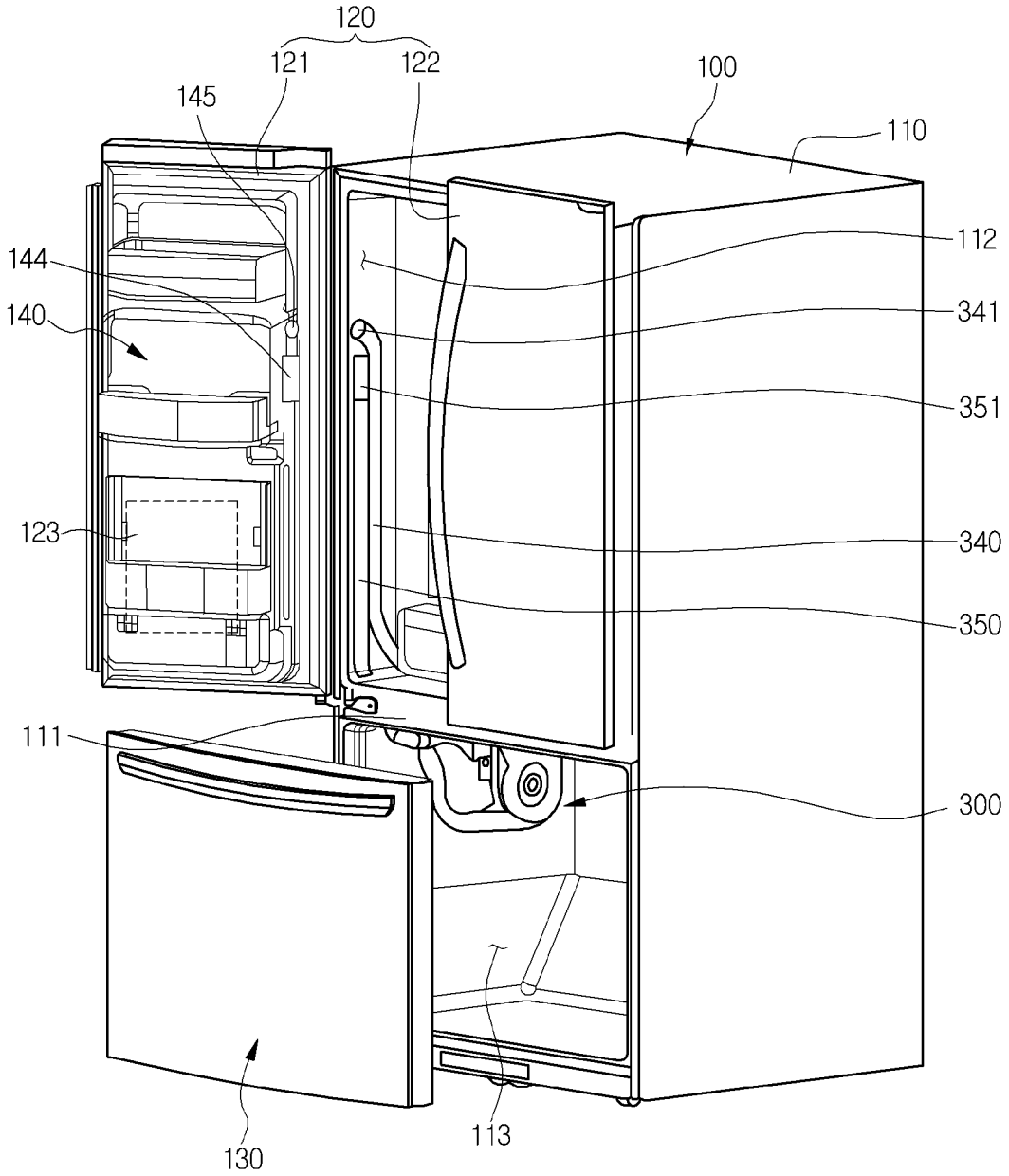
FIG. 3 is a perspective view of an example refrigerator.
Figure 4:
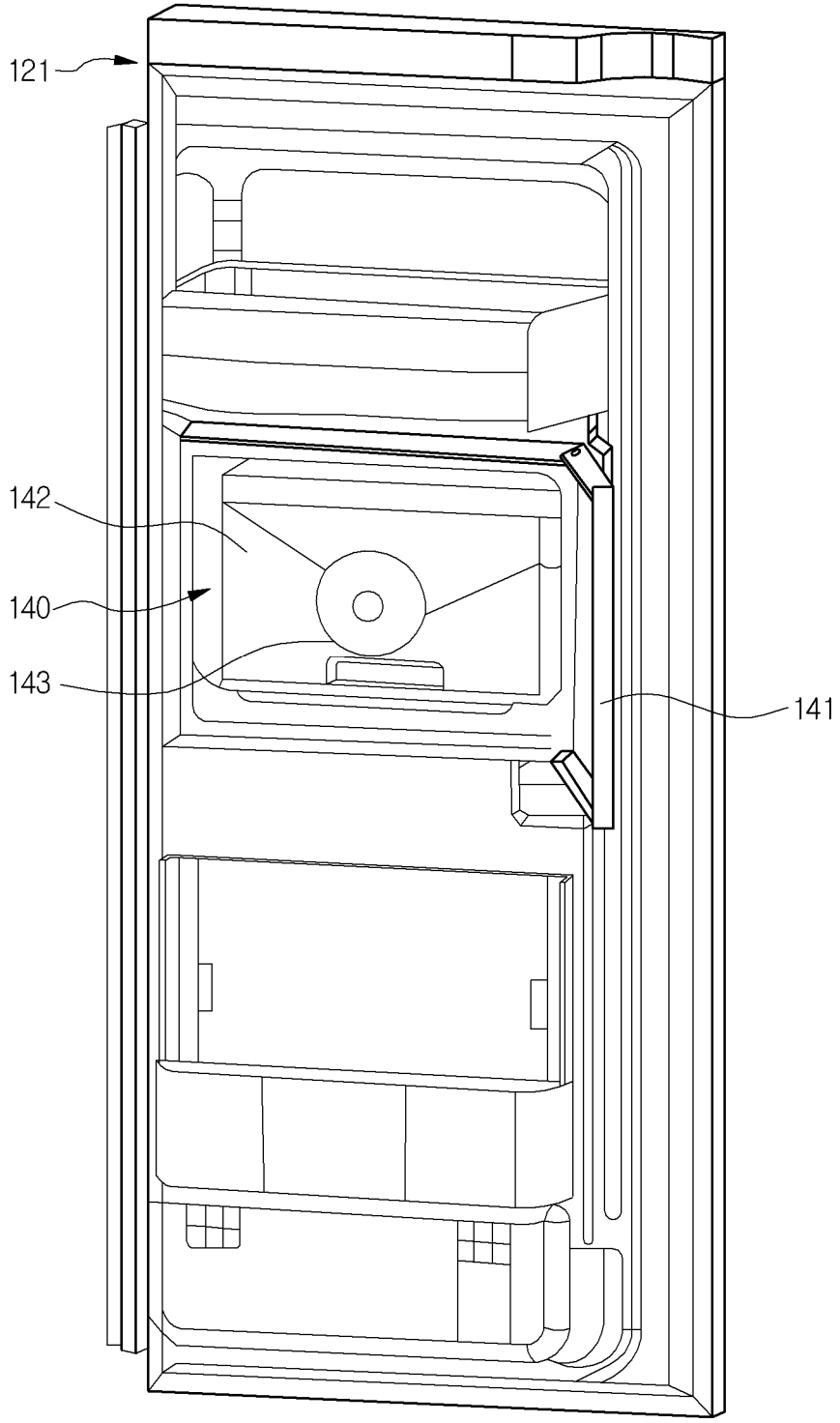
FIG. 4 is a perspective view illustrating an example door of the refrigerator shown in FIG. 3.
Figure 5:
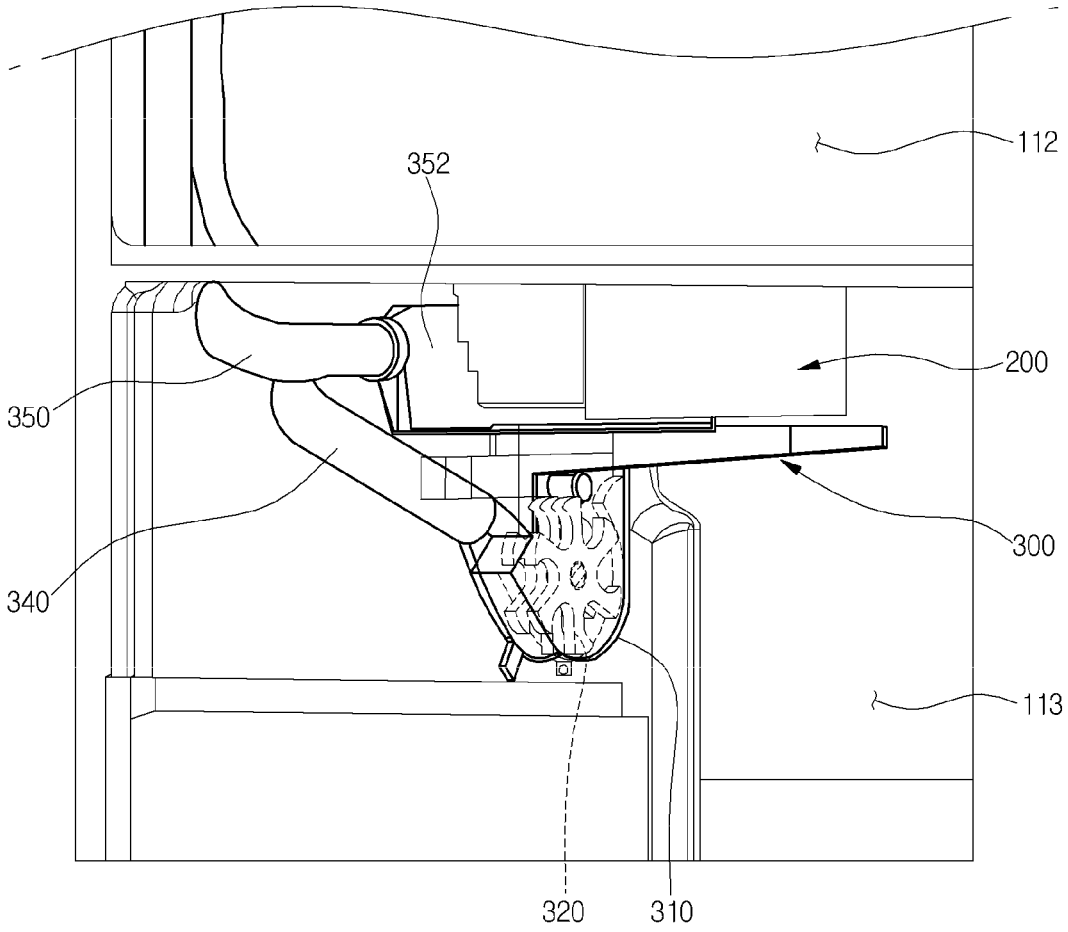
FIG. 5 is a partially perspective view illustrating an example inner structure of an example freezing compartment.

FIG. 3 illustrates an example refrigerator, FIG. 4 illustrates an example door of the refrigerator shown in FIG. 3, and FIG. 5 illustrates an example inner structure of an example freezing compartment.

Referring to FIGS. 3 to 5, a refrigerator 100 includes a cabinet 110 and a door. The cabinet 110 and the door define an outer appearance of the refrigerator 100. The inside of the cabinet 110 is partitioned by a barrier 111. That is, a refrigerating compartment 112 is defined at an upper side, and a freezing compartment 113 is defined at a lower side.

An ice maker 200 for making ice and an ice transfer device 300 for transferring the made ice into an ice bank 140 may be provided within the freezing compartment 113.

The door includes a refrigerating compartment door 120 for covering the refrigerating compartment 112 and a freezing compartment door 130 for covering the freezing compartment 113. The refrigerating compartment door 120 includes a first refrigerating compartment door 121 and a second refrigerating compartment door 122, which respectively rotate to open or close the refrigerating compartment 112. Also, the freezing compartment door 130 may be slidably withdrawn in front and rear directions to open or close the freezing compartment 113.

A dispenser 123 may be provided in a front surface of the first refrigerating compartment door 121. Purified water and ice made in the ice maker 200 may be dispensed to the outside through the dispenser 123.

The ice bank 140 is provided in a back surface of the refrigerating compartment door 120. The ice bank 140 provides a space for storing ice transferred by the ice transfer device 300. Also, the ice bank 140 (see FIG. 4) may be openable by a door 141. The ice bank 140 defines an insulation space. When the first refrigerating compartment door 121 is closed, the ice bank 140 is connected to the ice chute 340 and the cool air duct 350 to allow ice to be supplied and cool air to be circulated. The ice bank 140 communicates with the dispenser 123. Thus, when the dispenser 123 is manipulated, ice stored in the ice bank 140 may be dispensed. Also, a separate case 142 for accommodating ice may be provided within the ice bank 140. In addition, an auger 143 configured to smoothly transfer ice and a crusher for crushing ice to dispense crushed ice pieces may be further provided within the ice bank 140.

In some implementations, the ice bank 140 protrudes backward to allow a side surface part of the ice bank 140 to contact an inner wall of the refrigerating compartment 112 when the first refrigerating compartment door 121 is closed. Also, an air hole 144 and an ice inlet hole 145 may be further defined in a sidewall of the ice bank 140 corresponding to the openings 341 and 351 of the ice chute 340 and the cool air duct 350, which are disposed in the inner sidewall of the refrigerating compartment 112. Thus, when the first refrigerating compartment door 121 is closed, the ice may be transferred into the ice bank 140 and cool air for maintaining frozen states of the ice may be supplied.

A withdrawable drawer, the ice maker 200, and the ice transfer device 300 may be disposed inside the freezing compartment 113.

The ice maker 200 is configured to make ice using water supplied from a water supply source. The ice maker 200 may be disposed in the vicinity of an upper edge of the freezing compartment 113. The ice maker 200 is fixedly mounted on a bottom surface of the barrier 111. The ice made in the ice maker 200 may drop down and then be accommodated in a housing 310 of the ice transfer device 300.

Also, the ice transfer device 300 may be disposed under the ice maker 200 to supply the ice made in the ice maker 200 into the ice bank 140. For instance, the positions of the ice maker 200 and the ice transfer device 300 may be determined according to the position of the ice bank 140. For example, the ice maker 200 and the ice transfer device 300 may be provided in an upper left portion of the freezing compartment 113 that corresponds to the shortest distance from the ice bank 140 disposed in the first refrigerating compartment door 121.

In some examples, the ice transfer device 300 may be disposed under the ice maker 200 and fixedly mounted on a sidewall of the freezing compartment 113. In addition, a transfer member 320 for transferring ice may be disposed within the housing 310. The housing 310 is connected to the ice chute 340 to transfer the made ice into the ice bank 140 through the ice chute 340. Also, an end of the cool air duct 350 is disposed on a side of the ice transfer device 300. The cool air duct 350 is configured to supply the cool air within the freezing compartment 113 into the ice bank 140. An inlet of the cool air duct 350 may be exposed to the inside of the freezing compartment 113, and a cool air suction part 352 in which a blower fan 353 (see FIG. 7) is accommodated may be further disposed on an inlet-side of the cool air duct 350. The cool air suction part 352 communicates with an evaporating chamber in which an evaporator is disposed to allow cool air within the evaporating chamber to be supplied into the ice bank 140.

Figure 6:
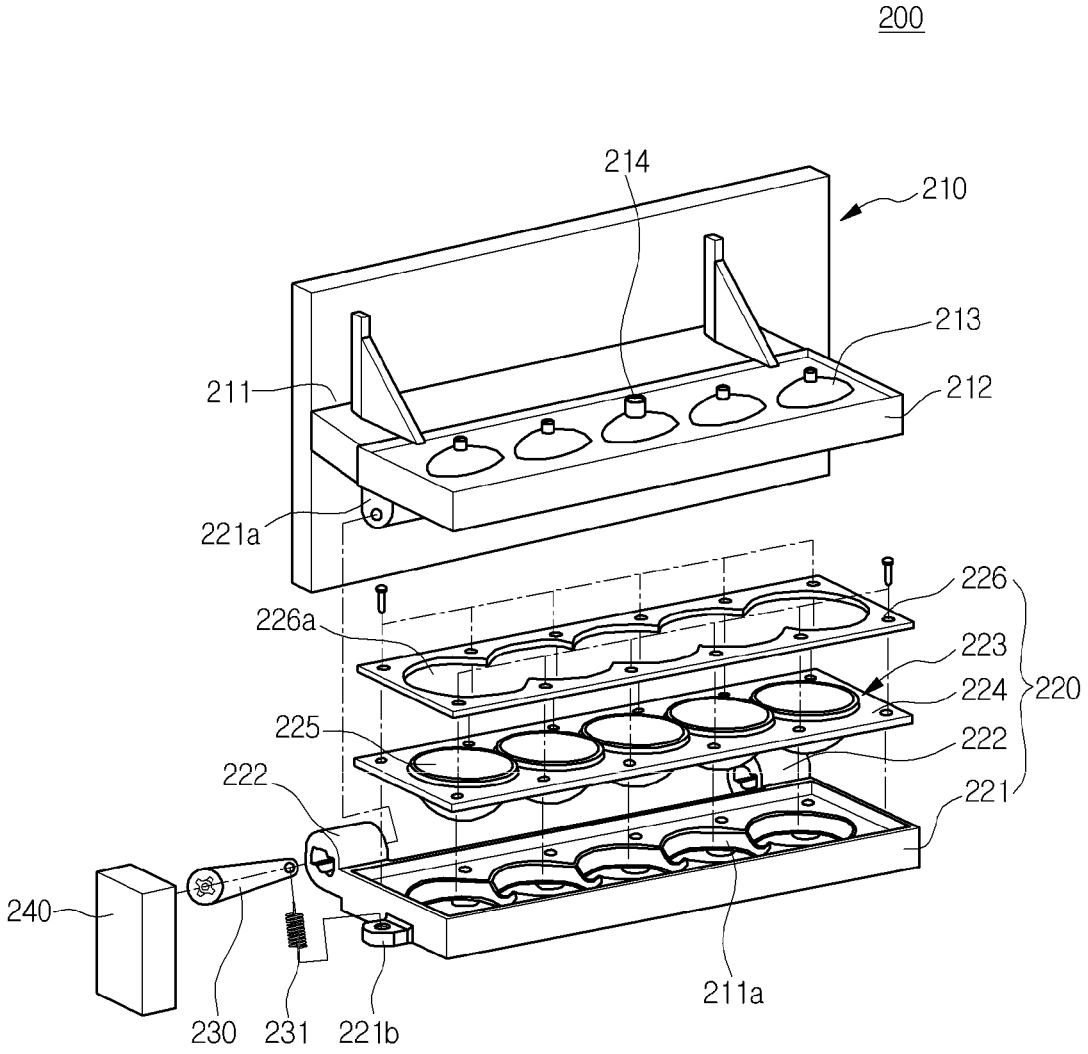
FIG. 6 is an exploded perspective view of an example ice maker.

FIG. 6 illustrates an example ice maker.

Referring to FIG. 6, the ice maker 200 is mounted on an ice maker bracket (see reference numeral 250 of FIG. 7) disposed on the barrier 111. Also, the ice maker 200 includes an upper plate tray 210, a lower plate tray 220 rotatably coupled to the upper plate tray 210, a motor assembly 240 providing rotation force to the lower plate tray 220, and an ejecting unit separating ice made in the upper and lower plate trays 210 and 220.

In some examples, the lower plate tray 220 has a substantially square shape when viewed from an upper side. Also, a recess part 225 recessed downward in a hemispherical shape to define a lower portion of a globular or spherical ice piece is defined in the lower plate tray 220. The lower plate tray 220 may be formed of a metal material. As necessary, at least a portion of the lower plate tray 120 may be formed of an elastically deformable material. An example in which a portion of the lower plate tray 220 is formed of an elastic material will be described.

The lower plate tray 220 includes a tray case 221 defining an outer appearance thereof, a tray body 223 seated on the tray case 221 and having the recess part 225, and a tray cover 226 for fixing the tray body 223 to the tray case 221.

The tray case 221 may have a square frame shape. Also, the tray case 221 may further extend upward and downward along a circumference thereof. Further, a seat part 221*a* punched in a circular shape is disposed within the tray case 221. The seat part 221*a* may have a shape corresponding to that of the recess part 225 of the tray body 223 so that the recess part 225 is stably seated thereon. That is to say, the seat part 221*a* may be rounded with the same curvature as that of the recess part 225. Thus, when an outer circumferential surface of the recess part is closely attached to the seat part 221*a*, the tray body 223 may be stably seated on the tray case 221 without being shaken.

The seat part 221*a* may be provided in plurality to correspond to the position and shape of the recess part 225. Thus, the plurality of seat parts 221*a* may be connected to each other.

Also, a lower plate tray connection part 222 coupled to the upper plate tray 210 and the motor assembly 240 so that the tray case 221 is rotatably mounted is disposed on a rear side of the tray case 221.

In addition, an elastic member mounting part 221*b* is disposed on a side surface of the tray case 221. Further, an elastic member 231 providing elastic force to maintain a closed state of the lower plate tray 220 may be connected to the elastic member mounting part 221*b*.

The tray body 223 may be formed of an elastically deformable flexible material. The tray body 223 is seated on the tray case 221. The tray body 223 includes a plane part 224 and the recess part 225 recessed downward from the plane part 224. The plane part 224 has a plate shape with a predetermined thickness. Also, the plane part 224 may have a shape to correspond to that of a top surface of the tray case 221 so that the plane part 224 is accommodated into the tray case 221. Also, the recess part 225 may have the hemispherical shape to define a lower portion of a globular or spherical cell providing a space in which an ice piece is made. The recess part 225 may have a shape corresponding to that of a recess part 213 of the upper plate tray 210. Thus, when the upper plate tray 210 and the lower plate tray 220 are closed, a shell providing a space having a globular or spherical shape may be defined.

The recess part 225 may pass through the seat part 221*a* of the tray case 221 to protrude downward. Thus, the recess part 225 may be pushed by the ejecting unit when the lower plate tray 220 rotates. As a result, an ice within the recess part 225 may be separated to the outside.

Also, a lower protrusion protruding upward is disposed around the recess part 225. When the upper plate tray 210 and the lower plate tray 220 are closed with respect to each other, the lower protrusion may overlap an upper protrusion of the upper plate tray 210 to reduce (e.g., prevent) water from leaking.

The tray cover 226 may be disposed above the tray body 223 to fix the tray body 223 to the tray case 221. A screw or rivet may be coupled to the tray cover 226. The screw or rivet successively passes through the tray cover 226, the tray body 223, and the tray case 221 to assemble the lower plate tray 220.

A punched part 226*a* having a shape corresponding to that of an opened top surface of the recess part 225 defined in the tray body 223 is defined in the tray cover 225. The punched part 226*a* may have a shape in which a plurality of circular shapes successively overlap each other. Thus, when the lower plate tray 220 is completely assembled, the opened top surface of the recess part 225 is exposed through the punched part 226*a*. Also, the lower protrusion protruding upward from an edge of a top surface of the recess part 225 is disposed inside the punched part 226*a*.

The upper plate tray 210 defines an upper appearance of the ice maker 200. The upper plate tray 210 may include a mounting part 211 for mounting the ice maker 200 and a tray part 212 for making ice.

For instance, the mounting part 211 is configured to mount the ice maker 200 inside the freezing compartment 113. The mounting part 211 may extend in a vertical direction perpendicular to that of the tray part 212. Thus, the mounting part 211 may surface-contact the freezing compartment 113 to maintain a stably mounted state thereof.

Also, the tray part 212 may have a shape corresponding to that of the lower plate tray 220. The tray part 212 may include a plurality of recess parts 213 each being recessed upward and having a hemispherical shape. The plurality of recess parts 213 are successively arranged in a line. When the upper plate tray 210 and the lower plate tray 220 are closed, the recess part 225 of the lower plate tray 220 and the recess part 213 of the upper plate tray 210 are coupled to match each other to define a shell which provides an ice making space having a globular or spherical shape. The recess part 213 of the upper plate tray 210 may have a hemispherical shape corresponding to that of the lower plate tray 220.

A shaft coupling part 211*a* to which the lower plate tray connection part 222 is shaft-coupled may be further disposed on a rear side of the tray part 212. The shaft coupling part 211*a* may extend downward from both sides of a bottom surface of the tray part 212 and be shaft-coupled to the lower plate tray connection part 222. Thus, the lower plate tray 220 may be shaft-coupled to the upper plate tray 210 and be rotatably mounted on the upper plate tray 220. That is, the lower plate tray 220 may be rotatably opened or closed by the rotation of the motor assembly 240.

The upper plate tray 210 may be formed entirely of a metal material. Thus, the upper plate tray 210 may be configured to quickly freeze water within the shell. Also, a heater for heating the upper plate tray 210 to separate ice from the upper plate tray 210 may be further disposed on the upper plate tray 210. Further, a water supply tube for supplying water into a water supply part 214 of the upper plate tray 210 may be disposed above the upper plate tray 210.

The recess part 213 of the upper plate tray 210 may be formed of an elastic material, like the recess part 225 of the lower plate tray 220, so that ice pieces are easily separated.

A rotating arm 230 and the elastic member 231 are disposed on a side of the lower plate tray 220. The rotating arm 230 may be provided for the tension of the elastic member 231. The rotating arm 230 may be rotatably mounted on the lower plate tray 220. The rotating arm 230 has one end shaft-coupled to the lower plate tray connection part 222. Also, the elastic member 231 has ends connected to the end of the rotating arm 230 and the elastic member mounting part 221*b*. In the state where the lower plate tray 220 and the upper plate tray 210 are closely attached and thus completely closed, the rotating arm 230 may further rotate to tension the elastic member 231. As a result, the lower plate tray 220 may be further closely attached to the upper plate tray by restoring force through which the elastic member 231 is contracted to securely reduce (e.g., prevent) water from leaking.

In the state where the lower plate tray 220 is closed, the rotating arm 230 further rotates in the direction in which the lower plate tray 220 is closely attached to the upper plate tray 210 to tension the elastic member 231. Thus, the lower plate tray 220 may be further closely attached to the upper plate tray 210 by the restoring force of the elastic member 231 to reduce (e.g., prevent) water from leaking.

The motor assembly 240 may be disposed on a side of the upper and lower plate trays 210 and 220 and include a motor. Also, the motor assembly 240 may include a plurality of gears that are combined with each other to adjust the rotation of the lower plate tray 220.

Figure 7:
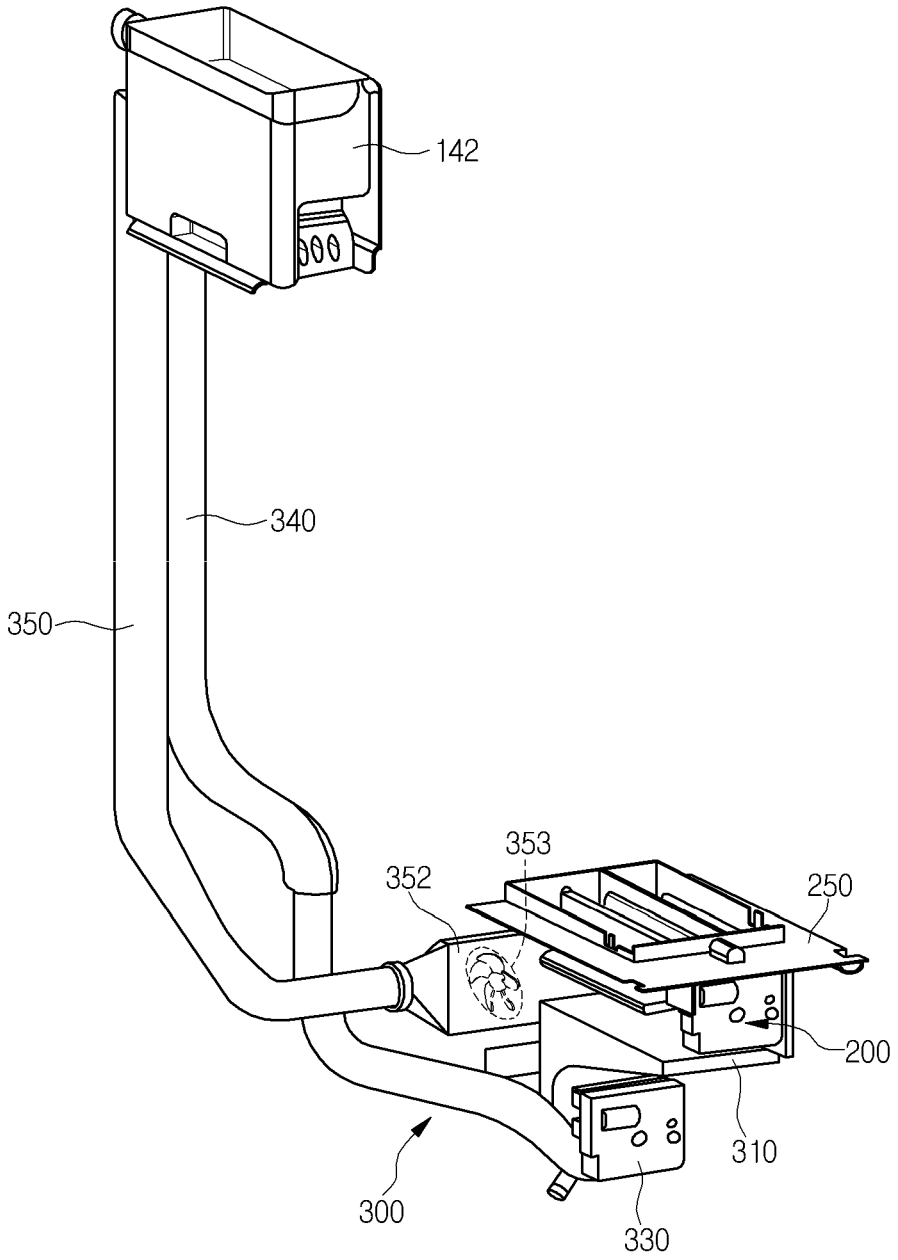
FIG. 7 is a perspective view illustrating an example overall structure of an example ice transfer device.
Figure 8:
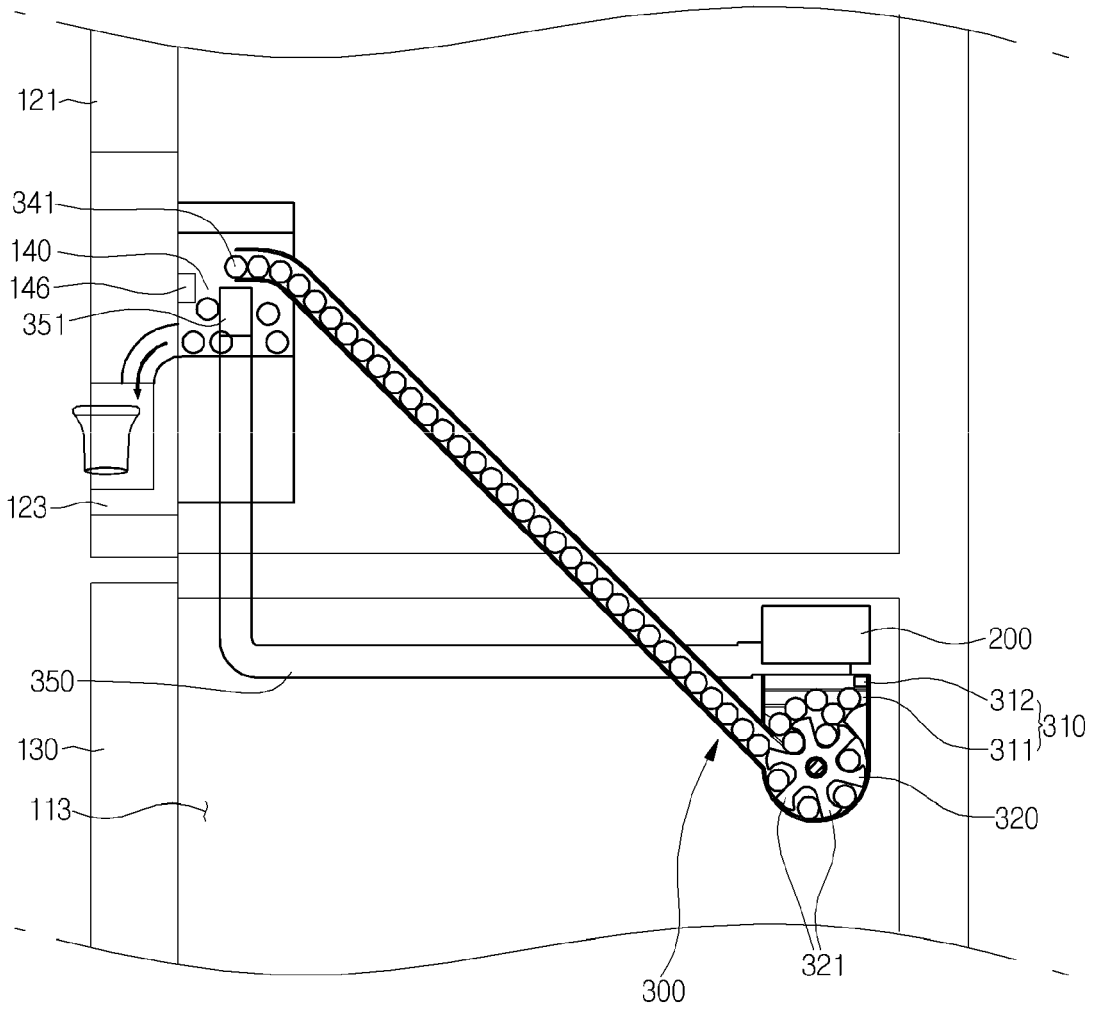
FIG. 8 is a schematic view illustrating an example ice transfer state through the ice transfer device shown in FIG. 7.
Figure 9:
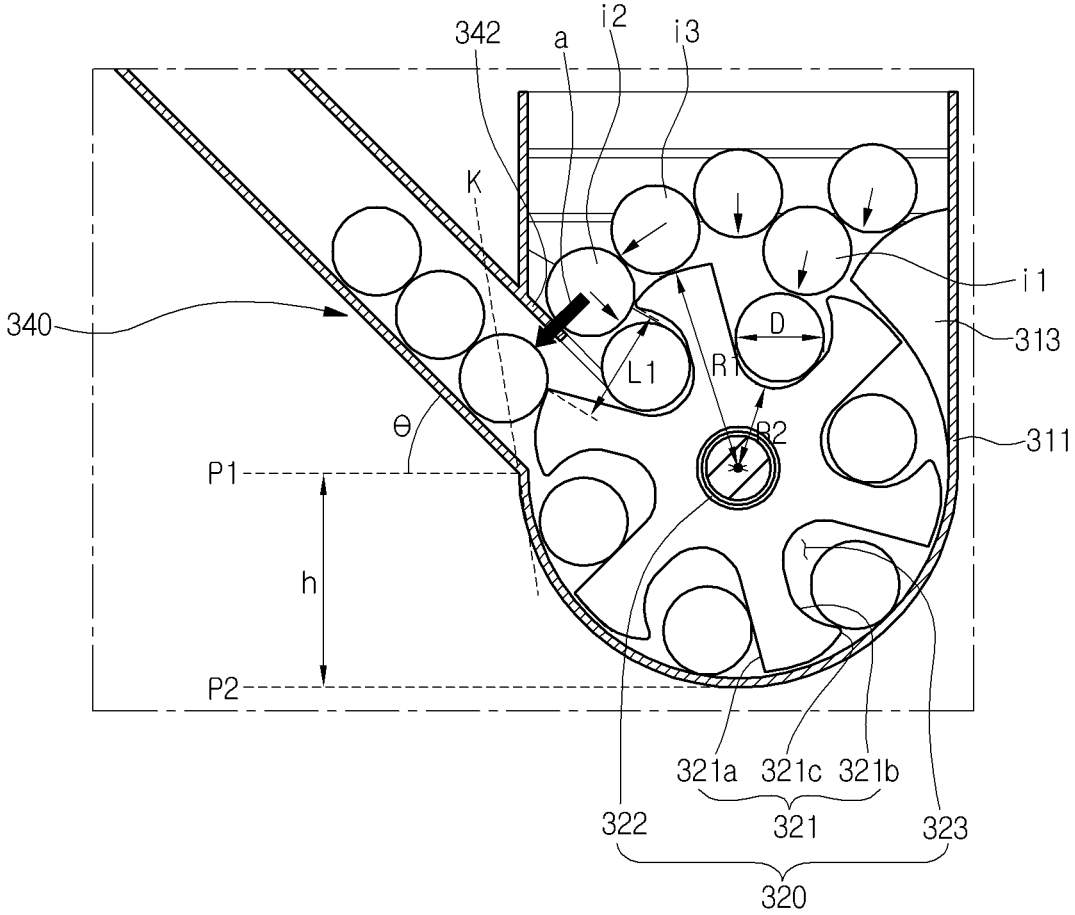
FIGS. 9 to 12 are views successively illustrating example operation processes in which ice pieces are guided into an example ice chute by an example transfer member.

FIG. 7 illustrates an example overall structure of an example ice transfer device, and FIG. 8 is illustrates an example ice transfer state through the ice transfer device shown in FIG. 7.

Referring to FIGS. 7 and 8, the ice transfer device 300 is disposed in the freezing compartment 113 and connected to the ice bank 140 via the freezing compartment 113, the refrigerating compartment 112, and the first refrigerating compartment door 121 to supply ice made in the ice maker 200 into the ice bank 140.

The ice transfer device 300 may be mounted within an inner case defining an inner surface of the cabinet 110 and be exposed to the inside of the refrigerator. For instance, the ice transfer device 300 may be mounted on a member such as a separate bracket coupled to the inner case. Also, at least a portion of the ice transfer device 300 may be buried by an insulation material between an outer case and the inner case of the cabinet 110 to provide insulation properties.

The ice transfer device 300 includes the housing 310 in which ice pieces separated from the ice maker 200 are primarily stored, the transfer member 320 disposed within the housing 310 to transfer the ice within the housing 310, a driving unit 330 for rotating the transfer member 320, and the ice chute 340 for guiding the ice within the housing 310 up to the dispenser 123.

The housing 310 is disposed under the ice maker 200. Also, a space for accommodating ice and the transfer member 320 is defined within the housing 310. Further, the housing 310 may have an opened top surface to allow the ice supplied from the ice maker 200 to drop therein and be accommodated.

In some examples, the top surface of the housing 310 may be disposed under the ice maker 200 and exposed to the inside of the freezing compartment 113. Also, a lower portion of the housing 310 in which the transfer member 320 is accommodated may be buried in the insulation material between the outer case and the inner case.

The transfer member 320 may have a gear or impeller shape. In some examples, the gear or impeller may be called as a lifter that lifts ice upward. In addition, the globular or spherical ice pieces made in the ice maker 200 may be accommodated between the plurality of lifters 321 disposed on the transfer member 320. Further, the lifters 321 may rotate to lift the ice pieces, thereby pushing the ice pieces toward the ice chute 340.

In some implementations, the entire transfer member 320 may be accommodated in the housing 310. A rotation shaft of the transfer member 320 passes though the housing 310 and is exposed to the outside of the housing 310. Also, the driving unit 330 is connected to the rotation shaft of the transfer member 320 to provide a power for rotating the transfer member 320.

The driving unit 330 includes a driving motor for providing rotation power and a gear assembly rotated by the driving motor. The gear assembly may be provided in plurality. Also, a plurality of gears may be combined with each other to control a rotation rate of the transfer member 320.

The ice chute 340 extends from a side of the housing 310 up to the first refrigerating compartment door 121 on which the ice bank 140 is mounted. Thus, the ice chute 340 may have a hollow tube shape so that globular or spherical ice pieces are transferred therethrough. For instance, the ice chute 340 may have an inner diameter corresponding to that of a globular or spherical ice piece or slightly greater than that of the globular or spherical ice piece. Thus, the made ice pieces may be successively transferred in a line.

The ice chute 340 may extend to pass through the barrier 111. Also, the ice chute 340 may be mounted so that the ice chute 340 is exposed to the inside of the freezing compartment 113 and the refrigerating compartment 112. For instance, the insulation member may be provided outside the ice chute 340 to reduce (e.g., prevent) the refrigerating compartment 112 from being heat-exchanged with the ice chute 340.

The ice chute 340 may be disposed between the outer case and the inner case. That is, the ice chute 340 may be disposed in a sidewall of the cabinet 110 corresponding to the first refrigerating compartment door 121. For example, the ice chute 340 may be thermally insulated by the insulation material within the cabinet 110 and not be exposed to the inside of the refrigerator.

The ice chute 340 may extend up to an inner sidewall of the refrigerating compartment 112 corresponding to a position of the ice bank 140. Also, the opening 341 opened in the inner wall of the refrigerating compartment 112 is defined in an upper end of the ice chute 340.

Thus, when the first refrigerating compartment door 121 is closed, the ice bank 140 and the ice chute 340 may communicate with each other. Thus, ice pieces may move along the ice chute 340 by the rotation of the transfer member 320 and be supplied into the ice bank 140.

The cool air duct 350 may be disposed along the refrigerating compartment 112 at a side of the freezing compartment 113. Also, the cool air duct 350 may be buried within the cabinet 100, like the ice chute 340. The cool air duct 350 communicates with the ice bank 140 in the state where the first refrigerating compartment door 121 is closed to supply cool air within the freezing compartment 113 into the ice bank 140. Thus, the cool air supplied into the cool air duct 350 cools the inside of the ice bank 140. Then, the cool air may return to the freezing compartment 113 through the ice chute 340 to realize the circulation of the cool air.

When the refrigerator 1 is operating, cool air generated in the evaporator may be supplied into the ice maker 200 that is disposed inside the freezing compartment 113. A globular or spherical ice piece may be made inside the ice maker 200 by using water supplied into the ice maker 200. When the ice is completely made, the ice drops down by the heater provided in the ice maker 200 or a component for separating the ice.

An upwardly opened inlet of the housing 310 may be defined under the ice maker 200, and thus the made globular or spherical ice piece may be supplied into the housing 310. The ice supplied through the upper side of the housing 310 may move according to the rotation of the transfer member 320.

In detail, the plurality of lifters 321 are disposed on the transfer member 320. Spaces in which each of the globular or spherical ice pieces are accommodated one by one are defined between the lifters 321. Thus, the ice introduced into the housing 310 is accommodated into the spaces between the plurality of lifters 321 disposed on the transfer member 320 by the rotation of the transfer member 320.

The ice pieces accommodated in the spaces defined in the transfer member 320 may be transferred by the rotation of the transfer member 320. Thus, the ice chute 340 may be maintained in a state where the made ice pieces fully fill the ice chute 340. In this regard, the transfer member 320 may rotate to push the ice pieces within the ice chute 340, thereby discharging the ice pieces into the ice bank 140.

The ice pieces discharged into the ice bank 140 are stored into the ice bank 140. The ice pieces stored in the ice bank 140 may be dispensed through the dispenser 123 when the dispenser 123 is manipulated.

Also, a full ice detection device 146 may be provided in the ice bank 140. In addition, a full ice detection device 312 may be additionally provided inside the housing 310. A preset amount or more of ice pieces may be filled into the ice bank 140 and the housing 310 by the full ice detection device disposed in each of the ice bank 140 and the housing 310. Further, the operation of the ice maker 200 may be controlled by the full ice detection device until the preset amount or more of ice pieces are fully filled. In this state, the transfer member 320 may operate to supply the ice pieces into the ice bank 140.

When a user manipulates the dispenser 123 in the state where the ice bank 140 is fully filled with ice, the operation of the driving unit 330 may start. When the transfer member 320 is rotated, the ice pieces accommodated in the spaces defined in the transfer member 320 may rotate together to push the ice pieces accommodated in a lower end of the ice chute 340 upward. When the ice pieces accommodated in the lower end of the ice chute 340 are pushed upward, the ice pieces successively stacked within the ice chute 340 may be pushed at the same time to ascend upward. Also, globular or spherical ice pieces may be supplied into the ice bank 140 through the opening 341 of the ice chute 340. Then, the ice pieces may be dispensed to the outside through the dispenser 123.

In some implementations, each of the ice pieces dispensed through the dispenser 123 may have a globular or spherical shape, and also, the user may dispense the desired number of ice pieces by manipulating the dispenser 123.

The operation of the driving unit 330 may be restricted by a door sensor for detecting an opening/closing of the refrigerating compartment door 120. That is, when the user manipulates the dispenser 123 in a state where the refrigerating compartment door 120 is opened, the driving unit 330 may not operate to prevent ice pieces from being dispensed.

A predetermined amount of ice pieces may be accommodated in the housing 310. Thus, the globular or spherical ice pieces may be successively transferred by the rotation of the transfer member 320. That is, ice pieces corresponding to the number of dispensed ice pieces may be supplied into the ice chute 340 to maintain a state in which the ice chute 340 is fully filled with ice.

In some implementations, the ice pieces may adhere to each other within the housing 310 or the ice chute 340, or the ice pieces may not be smoothly transferred due to foreign substances. In this state, when the transfer member 320 rotates, a load above a preset load may be applied. Thus, when the load above the preset load is detected from the driving unit 330, the motor of the driving unit 330 may reversely rotate.

When the driving unit 330 reversely rotates, the transfer member 320 may reversely rotate. Based on reverse rotation, ice pieces accommodated in the spaces of the transfer member 320 may move into the housing 310. Also, ice pieces within the ice chute 340 may smoothly move downward by their self-weight. Then, the ice pieces may move downward along the inclined ice chute 340. The ice pieces moving downward may be accommodated in the spaces of the transfer member 320 which reversely rotates, and then the ice pieces may successively move into the housing 310.

In some implementations, the driving unit 330 may reversely rotate for a preset time to completely empty the inside of the ice chute 340. In this state, the driving unit 330 may forwardly rotate to successively supply the ice pieces accommodated in the spaces of the transfer member 320 into the ice chute 340. Then, a process for transferring ice pieces may be prepared.

While the ice pieces are transferred, if two or more ice pieces are put into the space defined between the lifters 321, two or more ice pieces may be jammed or collide with each other and thus be damaged. Thus, a unit for reducing (e.g., preventing) the above-described phenomenon from occurring may be used.

Hereinafter, a jam or damage prevention unit for controlling ice pieces so that the ice pieces are put into the spaces defined between the lifters 321 of the transfer member 320 one by one when the transfer member 320 rotates to transfer the ice pieces will be described.

FIGS. 9 to 12 illustrate example operation processes in which ice pieces are guided into an ice chute by a transfer member.

Referring to FIGS. 9 to 12, the ice chute 340 extends from a transfer case 311. That is, the ice chute 340 extends from a horizontal plane at a predetermined inclined angle. A jam phenomenon in which a plurality of ice pieces are introduced into an ice accommodation groove 323 of the transfer member 320 may occur according to an inclined angle of the ice chute 340. In a case where an inclined angle θ of the ice chute 340 is equal to an angle between a tangent passing through an outer circumferential surface of the transfer case 311 and a horizontal plane at a point at which a lower end of the ice chute 340 start, when the transfer member 320 reversely rotates, at least two ice pieces may be accommodated into the ice accommodation hole 323 to cause the jam phenomenon in which the ice pieces adhere to each other or are broken.

To prevent the jam phenomenon from occurring, the ice chute 340 may extend upward at an incline from any point of the transfer case 311. For example, the ice chute 340 may be designed to extend so that the ice chute 340 is not parallel to a tangent passing through the outer circumferential surface of the transfer case 311 corresponding to the any point.

For instance, the inclined angle θ of the ice chute 340 with respect to the horizontal plane may be less than an angle between a tangent passing through the outer circumferential surface of the transfer case 311 corresponding to the point at which the lower end of the ice chute 340 starts and the horizontal plane. As a result, the starting point of the lower end of the ice chute 340 is spaced a predetermined height (h:h=P1-P2) from a bottom of the transfer case 311. Also, the inclined angle θ may have an angle ranging from about 0° to about 90°, particularly, ranging from about 20° to about 50°, and more particularly, an angle of about 45°.

To prevent ice pieces dropping from the ice bin 312 from being introduced (see an arrow a) into the ice chute 340 without being guided by the transfer member 320, an upper portion 342 of an inlet end of the ice chute 340 may extend by a predetermined length within the transfer case 311. Thus, the ice pieces dropping into the upper portion 342 of the inlet end may be guided toward a central shaft 322 of the transfer member 320 along the upper portion 342 of the inlet end that is inclined downward. In some implementations, the upper end 342 of the inlet end may extend up to the outside of a rotation region of the transfer member 320 so that the upper end 342 does not interfere with the lifter 321 when the transfer member rotates.

Also, the ice accommodation groove 323 may have a depth (R1-R2) greater than a diameter D of the ice pieces and less than double the diameter D. While the ice pieces are transferred toward the ice chute 340 or reversely transferred toward the transfer case 311, the ice accommodation groove 323 may have a depth so that only one ice piece is accommodated therein by an end of a leading edge 321*a* of the transfer member 320 or the tip part 321*c*.

Particularly, the ice accommodation groove 323 may have a depth less than half as much as the diameter D of the ice piece.

For instance, in a case where another ice piece is placed on an ice piece accommodated in the ice accommodation groove 323, when the transfer member 320 rotates, the upper ice piece is pressed by the end of the transfer member 320. When the end of the transfer member 320 contacts a point corresponding to a lower side from a center of the upper ice piece, the ice piece may be pressed by the transfer member 320 and thus be pushed to the outside of the rotation region of the transfer member 320. If the end of the transfer member 320 contacts a point corresponding to an upper side from the center of the upper ice piece, the jam phenomenon in which the upper ice piece is jammed or damaged between a guide part 313 and the end of the transfer member 320 may be occur.

Figure 10:
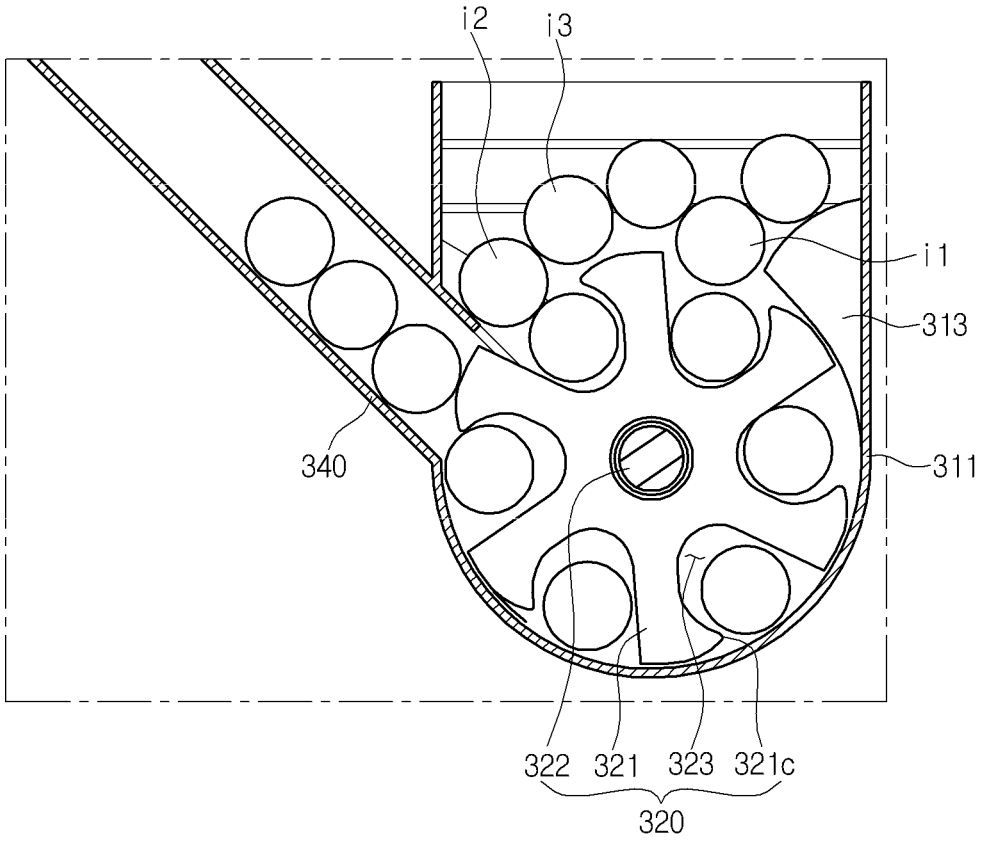
Figure 11:
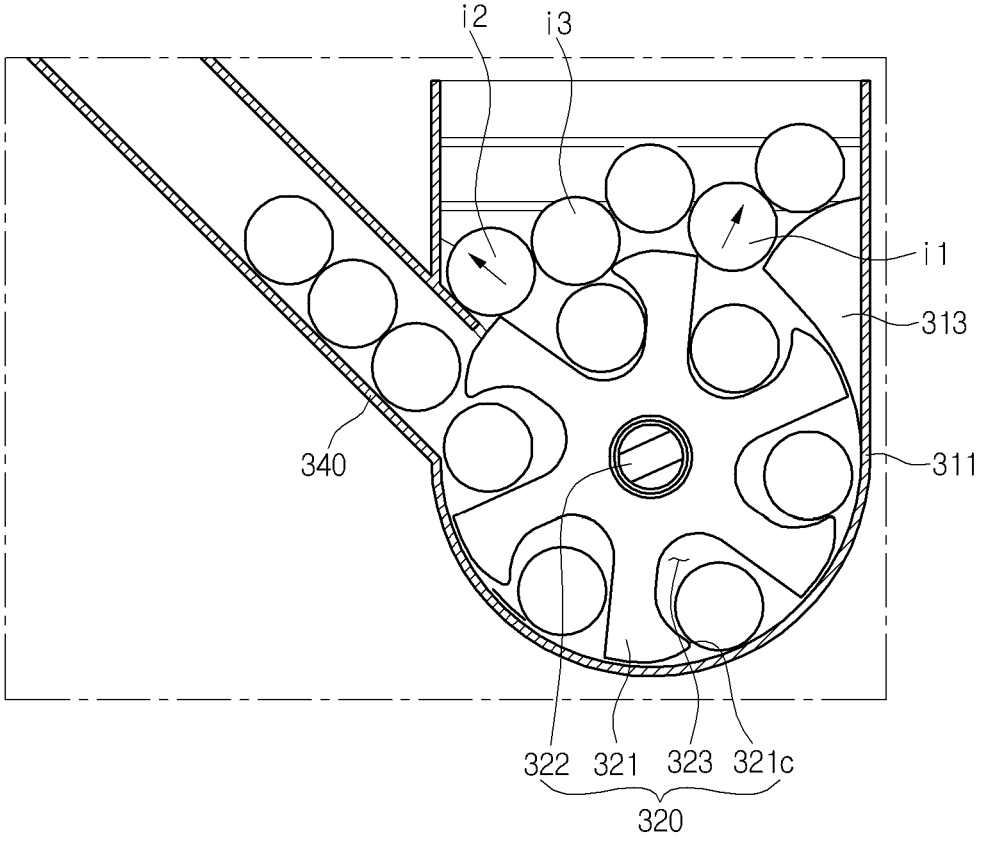
Figure 12:
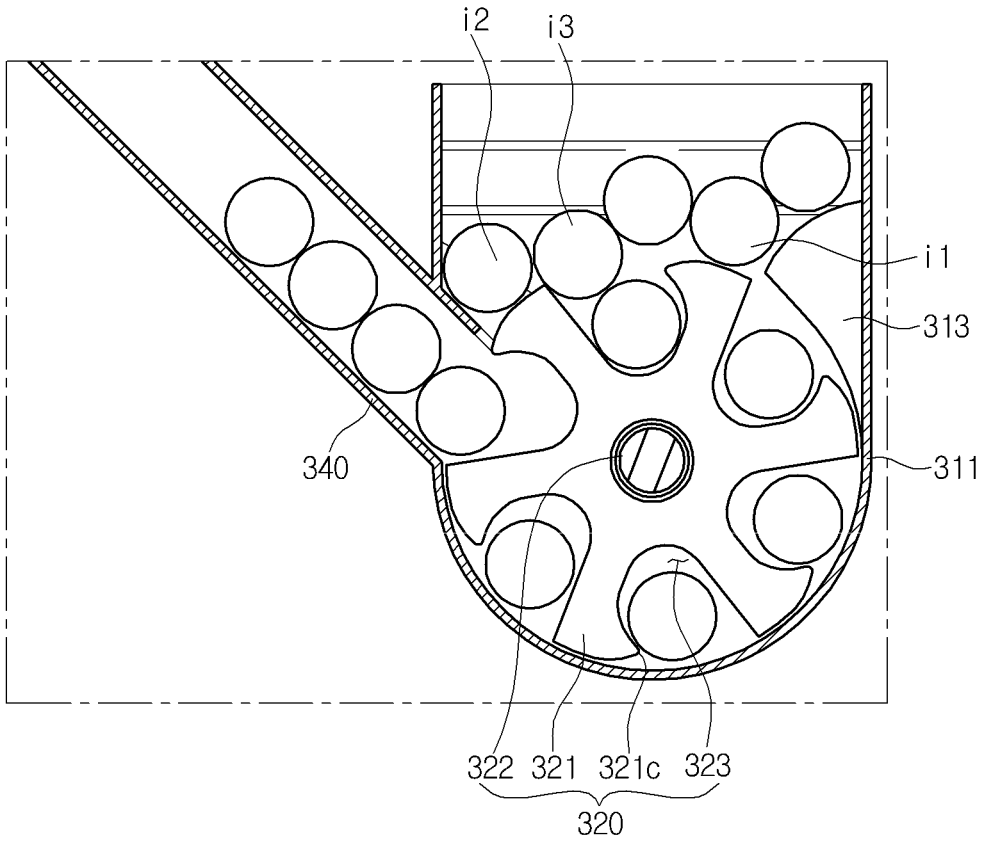

FIGS. 10 and 11 illustrate a moving process of an ice piece i1. As the transfer member 320 forwardly rotates, the leading edge 321*a* of the transfer member 320 contacts an outer circumferential surface of the ice piece i1. In this state, when the transfer member 320 further rotates, the ice piece i1 may be pushed from a space between the guide part 313 and the transfer member 320 to move upward. This is because the leading edge 321*a* of the transfer member 320 presses the point corresponding to the lower side from the center of the ice piece i1. The same result occurs in a case in which the transfer member 320 reversely rotates to allow the tip part 321*c* to contact the upper ice piece.

For the tip part 321*c*, a trailing edge 321*b* radially extends in a straight line shape like the leading edge 321*a*. Without the trailing edge 321*b* and the tip part 321*c*, a distance between the lifters 321 adjacent to each other may be excessively expanded to cause a phenomenon in which two ice pieces may be accommodated. According to the result of the experiment in which the number of lifters 321 is variously set in consideration of a size and moving rate of an ice accommodated into the ice accommodation groove 323 and an amount of ice supplied into the ice bank per unit time, when six lifters 321 are provided, a successful result may be obtained. Also, since the tip part 321*c* protrudes, one ice is accommodated in each of the ice accommodation grooves 323 to reduce (e.g., prevent) the jam phenomenon from occurring.

Also, a distance L1 between the tip part 321*c* and the leading edge 321*a* of the adjacent lifters 321 may be less than double the diameter D of the ice pieces. As described above, this is done for preventing two ice pieces from being accommodated in one ice accommodation groove 323.

According to the transfer mechanism including the above-described components, when the transfer member 320 rotates to forwardly or reversely transfer ice pieces, the jam phenomenon in which the ice pieces are jammed in the transfer member 320 or damaged may be reduced (e.g., prevented).

Since the ice maker is disposed in the freezing compartment, the space for storing foods in the back surface of the refrigerating compartment door may be further widely secured to expand the storage capacity of the refrigerator.

Since the ice making process is performed in the freezing compartment, it may be unnecessary to continuously supply strong cool air into the refrigerating compartment door for making ice. As a result, the cooling efficiency and power consumption saving may be improved. Also, since the ice making process is performed within the freezing compartment, the ice making efficiency may be improved.

When ice pieces are dispensed from the ice making compartment to transfer the ice pieces from the ice making compartment into the ice bank, the phenomenon in which the plurality of ice pieces are dispensed at once to collide with each other, thereby being damaged, or an overload is applied to the transfer unit to damage the parts may be reduced (e.g., prevented).

Although implementations have been described with reference to a number of illustrative examples thereof, it should be understood that numerous other modifications and implementations can be devised by those skilled in the art that will fall within the spirit and scope of the principles of this disclosure. More particularly, variations and modifications are possible in the component parts and/or arrangements and fall within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body comprising a freezing compartment and a refrigerating compartment;

a door configured to open and close at least a portion of the refrigerating compartment;

an ice maker disposed in the freezing compartment;

an ice bank disposed on the door and configured to store ice made by the ice maker;

an ice transfer device configured to transfer ice made by the ice maker to the ice bank; and an ice chute that connects the ice transfer device to the ice bank and defines a transfer path for ice from the ice transfer device to the ice bank, wherein the ice transfer device comprises:

a housing that receives ice separated from the ice maker; and a transfer member accommodated within the housing and with a plurality of lifters that radially extend from a center of the transfer member to transfer ice from the housing into the ice chute, wherein each of the lifters comprises:

a leading edge that defines a front surface of the lifter when the transfer member rotates in a forward direction;

a trailing edge that defines a rear surface of the lifter when the transfer member rotates in the forward direction; and a tip part that protrudes from an end of the trailing edge toward a circumference of the transfer member, and wherein the transfer member is configured to rotate in the forward direction to transfer ice from the housing into the ice chute.

2. The refrigerator according to claim 1, wherein the angle at which the ice chute extends is between about 0° to about 90°.

3. The refrigerator according to claim 1, wherein the angle at which the ice chute extends is between about 20° to about 50°.

4. The refrigerator according to claim 3, wherein the angle at which the ice chute extends is about 45°.

5. The refrigerator according to claim 2, wherein the angle at which the ice chute extends is between 20° to 50°.

6. The refrigerator according to claim 5, wherein the angle at which the ice chute extends is 45°.

7. The refrigerator according to claim 1, wherein an upper end of the inlet end of the ice chute extends into the housing by a predetermined length.

8. The refrigerator according to claim 7, wherein the lower end of the inlet end of the ice chute does not extend into the housing.

9. The refrigerator according to claim 1, wherein an ice accommodation groove configured to accommodate ice located in the housing is defined between each pair of adjacent lifters.

10. The refrigerator according to claim 9, wherein the ice accommodation groove has a depth ranging from about one time to about one and a half times a diameter of an ice piece the ice maker is configured to make.

11. The refrigerator according to claim 1, wherein a distance between the tip part and the leading edge of adjacent lifters is about one time to about one and a half times a diameter of an ice piece the ice maker is configured to make.

12. The refrigerator according to claim 1, further comprising a guide part that protrudes from an inner circumferential surface of the housing and that is configured to guide ice dropping from the ice maker toward the transfer member.

13. The refrigerator according to claim 12, wherein the guide part comprises:

a first surface protruding downward from an inner circumferential surface of the housing; and a second surface connecting an end of the first surface to the inner circumferential surface of the housing, the second surface being rounded with a curvature that is equal to or greater than the curvature of the transfer member.

14. The refrigerator according to claim 13, wherein the first surface is inclined such that the first surface protrudes downward from the inner circumferential surface of the housing in an inclined manner.

15. The refrigerator according to claim 13, wherein the first surface is rounded such that the first surface protrudes downward from the inner circumferential surface of the housing in a rounded manner.

16. The refrigerator according to claim 13, wherein the second surface is rounded with a curvature that is equal to the curvature of the transfer member.

17. The refrigerator according to claim 13, wherein the second surface is rounded with a curvature that is greater than the curvature of the transfer member.

18. The refrigerator according to claim 1, wherein the plurality of lifters are six lifters.

19. The refrigerator according to claim 1, wherein the ice maker is configured to make spherical ice.

20. The refrigerator according to claim 1, wherein an inlet end of the ice chute is located at a point that is spaced upward from a bottom surface of the housing, and the ice chute is configured to extend from the inlet end upward from a horizontal plane at an angle.

* * * * *